US012422166B2

(12) United States Patent
De Gea

(10) Patent No.: US 12,422,166 B2
(45) Date of Patent: Sep. 23, 2025

(54) MODULAR CONDENSATE REMOVAL SYSTEM, MODULES AND CORRESPONDING INSTALLATION AND MAINTENANCE METHODS

(71) Applicant: SAUERMANN INDUSTRIE, Chevry-Cossigny (FR)

(72) Inventor: Olivier De Gea, Saint-Vrain (FR)

(73) Assignee: SAUERMANN INDUSTRIE, Chevry-Cossigny (FR)

( * ) Notice: Subject to any disclaimer, the term of this patent is extended or adjusted under 35 U.S.C. 154(b) by 101 days.

(21) Appl. No.: 18/293,114

(22) PCT Filed: Jul. 29, 2022

(86) PCT No.: PCT/EP2022/071458
§ 371 (c)(1),
(2) Date: Jan. 29, 2024

(87) PCT Pub. No.: WO2023/007005
PCT Pub. Date: Feb. 2, 2023

(65) Prior Publication Data

US 2024/0328667 A1 Oct. 3, 2024

(30) Foreign Application Priority Data

Jul. 30, 2021 (FR) ..... 2108340

(51) Int. Cl.
*F24F 13/22* (2006.01)
*F04B 23/02* (2006.01)
(Continued)

(52) U.S. Cl.
CPC ..... *F24F 13/222* (2013.01); *F04B 23/02* (2013.01); *F04B 49/025* (2013.01); *F04B 53/16* (2013.01); *F24F 13/20* (2013.01); *F24F 2221/36* (2013.01)

(58) Field of Classification Search
CPC ..... F24F 13/22; F24F 13/222; F24F 2221/36; F24F 13/20; F04B 23/02; F04B 49/025; F04B 53/16; F25D 21/02; F25D 2321/14
See application file for complete search history.

(56) References Cited

U.S. PATENT DOCUMENTS 5,562,003 A * 10/1996 Lefebvre ..... G01F 23/74 73/314
2009/0064698 A1* 3/2009 Spanger ..... F24F 13/222 62/289

(Continued)

FOREIGN PATENT DOCUMENTS

WO 2017050405 A1 3/2017
WO 2017050405 A8 5/2017
WO 2020025491 A1 2/2020

OTHER PUBLICATIONS

International Search Report dated Oct. 4, 2022 for corresponding International Application No. PCT/EP2022/071458, filed Jul. 29, 2022.

(Continued)

*Primary Examiner* — Joseph F Trpisovsky
(74) *Attorney, Agent, or Firm* — David D. Brush; Westman, Champlin & Koehler, P.A.

(57) ABSTRACT

A condensate removal system including at least three independent modules: a pumping module, a detection module and a control module. The pumping module includes a pump. The detection module includes a tank for receiving condensates and is capable of detecting at least two levels of condensates in the tank. The control module includes electronics for controlling the pump based on the levels of condensates. Each of the modules includes hydraulic and/or electrical connections to at least one other module, and at least two of the modules include a reversible attachment to one another, so that the at least three modules can be (Continued)

connected according to at least two configurations among: an aligned configuration; a two-piece configuration; or a one-piece configuration.

18 Claims, 8 Drawing Sheets

(51) Int. Cl.

| | |
|---|---|
| ***F04B 49/025*** | (2006.01) |
| ***F04B 53/16*** | (2006.01) |
| ***F24F 13/20*** | (2006.01) |

(56) References Cited

U.S. PATENT DOCUMENTS

| | | | | |
|---|---|---|---|---|
| 2010/0064705 | A1* | 3/2010 | Chauvin ..... | F04B 49/10 700/282 |
| 2012/0282111 | A1 | 11/2012 | Nip et al. | |

OTHER PUBLICATIONS

Written Opinion of the International Searching Authority dated Oct. 4, 2022 for corresponding International Application No. PCT/EP2022/071458, filed Jul. 29, 2022.

International Preliminary Report on Patentability dated Oct. 11, 2023 for corresponding International Application No. PCT/EP2022/071458, filed Jul. 29, 2022.

French Search Report and Written Opinion dated Jun. 1, 2022 for corresponding French Application No. 2108340, filed Jul. 30, 2021.

* cited by examiner

MODULAR CONDENSATE REMOVAL SYSTEM, MODULES AND CORRESPONDING INSTALLATION AND MAINTENANCE METHODS

1. CROSS-REFERENCE TO RELATED APPLICATIONS

This Application is a Section 371 National Stage Application of International Application No. PCT/EP2022/071458, filed Jul. 29, 2022, which is incorporated by reference in its entirety and published as WO 2023/007005 A1 on Feb. 2, 2023, not in English.

2. TECHNICAL FIELD OF THE INVENTION

The field of the invention is that of the removal of condensates, implemented in systems producing condensates, particularly air-conditioning systems, cooling systems, ventilation systems or heating systems.

More particularly, the invention relates to the optimisation of the assembly and to the installation of condensate removal means in such systems.

3. TECHNOLOGICAL BACKGROUND

The use of condensate removal pumps is a technique well known in many applications, among which air-conditioning systems, cooling systems, ventilation systems, heating systems, etc. The applicant, particularly, develops and markets various devices adapted to all situations and all needs.

In these various applications, a condensate removal system is used for detecting, suctioning and discharging the condensates towards a wastewater outlet.

Such a system therefore essentially comprises a pump, electronics for controlling the latter and a water level detector in a tank, generally included in a plastic shell to form an assembly of small size and often of shape adapted to a particular use. Indeed, it is generally desired that the overall size of the removal system is compact and adapted to the environment.

Figure 1:
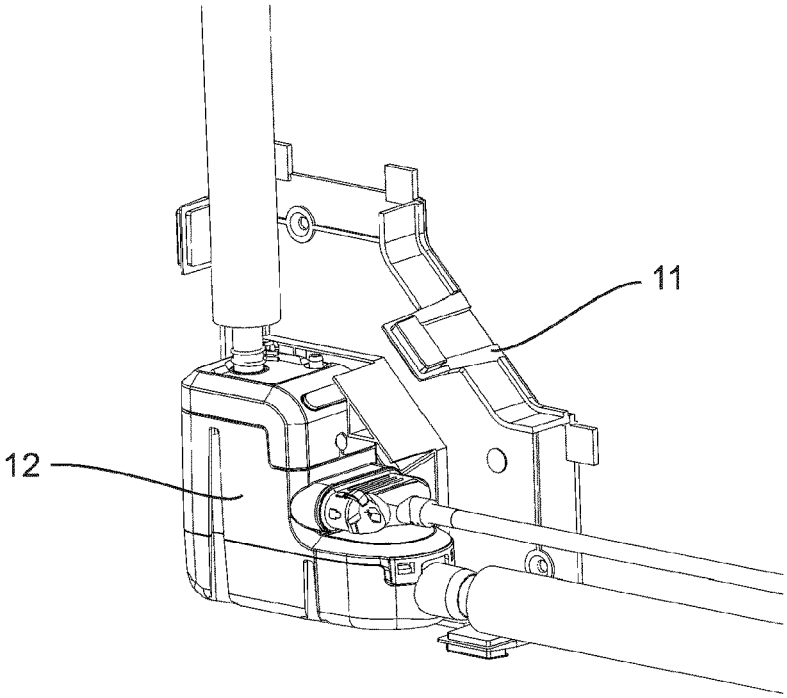

Thus, as illustrated in FIG. 1, it is conventional to install a removal device 11 in an elbow 12, wherein ducts and pipes also circulate. The shape of the device is specifically adapted to that of the elbow, for an efficient installation. This approach is interesting, but restricts the use of the device to particular applications. For example, the volume of the device may make its installation impossible other than in an elbow, the available height for the installation being insufficient. The volume of such devices is therefore a drawback in certain implementations.

Consequently, this approach requires developing a wide range of products, according to the available space, the pumping capacities, etc.

This approach makes seemingly easy maintenance possible, since in the event of a fault, the device simply needs to be replaced. However, this is expensive, and it is not possible, for example, to only replace a faulty detector.

It has sometimes been proposed, for certain installations, to place the detector at a distance from the pump, with a wired connection between the detector and the electronics of the pump. These removal systems are thus adapted to installations other than in an elbow.

However, this leads to the design of specific systems, and therefore to a multiplication of types of removal systems, on the basis of the shapes, of the possible installations, of the desired powers or flow rates, etc. This obviously introduces production and storage complexities, with manufacturers, distributors and installers.

In particular, one drawback of the current approach is the lack of optimisation of the maintenance. Currently, the tradesperson carrying out the installation and the maintenance of such installations, must have a wide variety as diversified as possible of the various types of systems that may exist on the market in order to adapt to each installation/maintenance configuration. This represents a cost and a substantial storage volume, as well as a loss of time for the tradesperson.

From the point of view of industrialisation, the current solutions induce a multiplication of references and therefore a complex stock management (each configuration having its own electronic board, its own casing, its own packaging, etc.), a substantial production time, as well as difficulty in upgrading the product since any upgrade of a part thereof induces a reorganisation of the entire production chain.

Therefore, there is a need to simplify the industrialisation, installation and maintenance of condensate removal systems.

4. SUMMARY OF THE INVENTION

An aspect of the present disclosure relates to a condensate removal system comprising at least three independent modules:

- a pumping module, comprising a pump;
- a detection module, comprising a tank for receiving condensates and a detector capable of detecting at least two levels of condensates in said tank; and
- a control module, comprising electronic means controlling said pump on the basis of said levels of condensates; and each of said modules comprising connection means for hydraulic and/or electrical connection to at least one other module, and at least two of said modules comprising means for reversible attachment to one another, so that said at least three modules can be connected according to at least two (preferably the three) of the configurations belonging to the group comprising:

- an aligned configuration, wherein said modules are installed separated from one another;
- a so-called two-piece configuration, wherein two of said modules are attached to one another; or
- a so-called one-piece configuration, wherein said pumping module, said detection module and said control module are attached to one another.

Thus, the invention is based on a modular approach for facilitating the installation by offering an installation versatility based on three basic modules. Based on three modules, it is possible to implement various configurations.

This also makes it possible to optimise the maintenance that may only be partial (changing a single module and not the complete product).

Moreover, from the point of view of industrialisation, this makes it possible to reduce the number of references by pooling components, and to reduce the production time by eliminating certain assembly phases that are postponed to the end customer.

The tradesperson only needs to have three basic modules in order to install or carry out the maintenance of any configuration of the system. Therefore, this reduces their stocks and their purchasing costs.

In addition, this makes it possible to increase the upgradeability of the product. Indeed, a module may subsequently be available in a plurality of versions. For example, the electronic part may be more or less intelligent. Thus, by only changing one module, the overall product can be transformed on the basis of the needs. In this case, the tradesperson may, for example, have two or three distinct control modules to be able to implement a wide range of installation combinations.

Moreover, the use of three modules of small size and flexibly connected to one another (cables, pipes) makes many implantations and adaptations possible, in particular in highly restricted environments, compared to a single product in a rigid casing.

For the industrialist, this makes simplified stock management possible since there are only three modules (or series of modules), that are identical for all system configurations. In addition, upgrading the system becomes easier, since upgrading one of the modules does not affect the manufacture of the others.

According to a particular embodiment of the invention, at least one first of said modules has a casing configured to be assembled with a casing of a second of said modules, so as to attach said first and second module.

Thus, attaching these casings makes it possible to obtain a first assembly type and therefore a first configuration of the system. This attachment also makes it possible to improve the volume of the system, and facilitates the hydraulic and/or electrical connections.

This attachment is preferably reversible, and achievable, for both the attachment and for the separation, without tools.

According to a particular embodiment of the invention, said casings have shapes adapted to interlock, for example by having respectively a contained dovetail tenon and a containing dovetail groove. Of course, many other means and shapes can be envisaged, for a simple and effective attachment, using means for interlocking (pins, clips, etc.) or another mode of attachment (magnets, Velcro®, etc.).

Thus, the assembly is simple and quick to implement, as is the industrialisation.

According to a particular embodiment of the invention, said first and second module are said control module and said pumping module.

Thus, it is possible to group, if necessary, these two modules, the detection module being at a distance. This improves the adaptability of the system to the various installation configurations.

According to a particular embodiment of the invention, said system comprises a removable attachment part for attaching to one another said detection module and said pumping module and/or said control module.

According to a particular embodiment of the invention, said attachment part comprises a plate having on the one hand means for attaching to said detection module and on the other hand means for attaching to said pumping module or to said control module.

This approach has the advantage of being able to implement the invention easily, particularly with pre-existing casings. It is also possible that the plate, or equivalent means, are integrated directly in the casing.

According to a particular embodiment of the invention, said attachment part makes it possible to install said pumping module and/or said control module in vertical position.

This particularly makes it possible to obtain a system similar to the one-piece device of the prior art, described above, and for example an installation in an elbow. In this particular case, the plate and the casings are organised so as to be placed in the elbow, taking into account the specific constraints thereof (internal walls, guides, holding elements, etc.). Consequently, this improves the adaptability of the system to the various installation configurations.

According to a particular embodiment of the invention, said attachment part has at least one portion for guiding and/or clamping at least one of said connection means.

This makes it possible to facilitate the installation and improve the holding of the system during positioning and after installing.

According to a particular embodiment of the invention, said guiding and/or clamping portion comprises a housing for receiving a clip for holding a tube.

According to a particular embodiment of the invention, at least one of said modules has a casing wherein a housing is formed for receiving, at least partly, and/or for guiding, an electrical cable and/or a tube.

Thus, this makes it possible to save space and optimise the volume of the system, making it possible for it to adapt to all installation configurations, the cables or tubes being able to be fully or partly housed in the equivalent parallelepiped volume of the casing, and not circulate along it. In other terms, the available space simply needs to correspond to the equivalent volume of the casing, to make the installation possible.

Furthermore, this facilitates the installation, the location of the cables and tubes being defined, or at least suggested.

Thus, according to a particular embodiment of the invention, one of the modules, for example said pumping module, comprises at least one groove capable of receiving an electrical cable connecting said detection module to said control module.

Likewise, according to a particular embodiment of the invention, one of said modules, for example said control module, comprises at least one housing capable of receiving a tube connecting said detection module to said pumping module.

According to a particular embodiment of the invention, said pumping module comprises an oscillating piston pump.

Other types of pumps may of course be implemented. The pumping module may moreover also particularly comprise a thermal protection and the connection to the control module.

According to a particular embodiment of the invention, said detection module comprises at least one sensor belonging to the group comprising:

the float sensors;

the capacitive sensors;

the resistive sensors;

the optical sensors.

The various particular features listed above may of course be combined with one another, according to all possible configurations.

The invention also relates to each of the modules itself, and in particular:

- a pumping module for a condensate removal system such as described above, comprising a pump and means for reversible attachment to said detection module and/or said control module.
- a detection module for a condensate removal system according to one of the preceding implementations, comprising a tank for receiving condensates and a detector capable of detecting at least two levels of condensates in said tank, and means for reversible attachment to said pumping module and/or said control module;
- a control module for a condensate removal system according to one of the preceding implementations, comprising electronic means controlling said pump on the basis of said levels of condensates and means for reversible attachment to said pumping module and/or said control module.

More specifically, the invention also relates to a pumping module for a condensate removal system comprising at least three independent modules:

a pumping module, comprising a pump;

a detection module, comprising a tank for receiving condensates and a detector capable of detecting at least two levels of condensates in said tank; and a control module, comprising electronic means controlling said pump on the basis of said levels of condensates, said pumping module also comprising connection means for hydraulic and/or electrical connection to at least one other module belonging to the group comprising said detection module and said control module, and means for reversible attachment to said detection module and/or said control module, adapted so that said pumping module can be connected to said detection module and/or said control module according to at least two of the configurations belonging to the group comprising:

an aligned configuration, wherein said modules are installed separated from one another;

1 a so-called two-piece configuration, wherein two of said modules are attached to one another; or a so-called one-piece configuration, wherein said pumping module, said detection module and said control module are attached to one another.

The invention also relates to a detection module for a condensate removal system comprising at least three independent modules:

a pumping module, comprising a pump;

a detection module, comprising a tank for receiving condensates and a detector capable of detecting at least two levels of condensates in said tank; and a control module, comprising electronic means controlling said pump on the basis of said levels of condensates, said detection module also comprising connection means for hydraulic and/or electrical connection to at least one other module belonging to the group comprising said pumping module and said control module, and means for reversible attachment to said pumping module and/or said control module, adapted so that said detection module can be connected to said pumping module and/or said control module according to at least two of the configurations belonging to the group comprising:

an aligned configuration, wherein said modules are installed separated from one another;

a so-called two-piece configuration, wherein two of said modules are attached to one another; or a so-called one-piece configuration, wherein said pumping module, said detection module and said control module are attached to one another.

The invention also relates to a control module for a condensate removal system comprising at least three independent modules:

a pumping module, comprising a pump;

a detection module, comprising a tank for receiving condensates and a detector capable of detecting at least two levels of condensates in said tank; and a control module, comprising electronic means controlling said pump on the basis of said levels of condensates, said control module also comprising connection means for hydraulic and/or electrical connection to at least one other module belonging to the group comprising said pumping module and said detection module, and means for reversible attachment to said pumping module and/or said detection module, adapted so that said control module can be connected to said pumping module and/or said detection module according to at least two of the configurations belonging to the group comprising:

an aligned configuration, wherein said modules are installed separated from one another;

a so-called two-piece configuration, wherein two of said modules are attached to one another; or a so-called one-piece configuration, wherein said pumping module, said detection module and said control module are attached to one another.

The invention also relates to a method for installing and/or maintaining a condensate removal system according to one of the preceding implementations, comprising the following steps of:

obtaining said at least three modules, separated from one another;

assembling said at least three modules that can be connected according to at least two of the configurations belonging to the group comprising:

an aligned configuration, wherein said modules are installed separated from one another and aligned substantially horizontally;

a so-called two-piece configuration, wherein two of said modules are attached to one another; or a so-called one-piece configuration, wherein said pumping module, said detection module and said control module are attached to one another, on the basis of the available space and/or of the configuration of an installation receiving said condensate removal system.

Thus, the invention makes it possible to obtain various configurations of the system, making it possible for it to adapt to any type of installation environment using one or other of the configurations, based on the three modules available.

According to a particular embodiment of the invention, said method comprises a step of replacing and/or intervening on only one of said modules.

Thus, the maintenance of the system is simpler and less expensive since only a single module and not the whole system needs to be changed. It is also possible to upgrade the installation, by replacing one of the modules, for example the control module by a higher performance version, without replacing the entire system.

According to a particular embodiment of the invention, in said one-piece configuration, said modules are assembled so as to be able to be housed particularly in an elbow installed on one side of a wall-mounted air-conditioning unit.

Thus, the system is extremely compact and adapts to a particular type of installation configuration. With the same modules, it is possible to address the specific constraints of these elbows, which generally require a specific model, while addressing the constraints of other situations, for example when the available space extends over a low height (aligned configuration).

5. LIST OF FIGURES

Figure 2A:
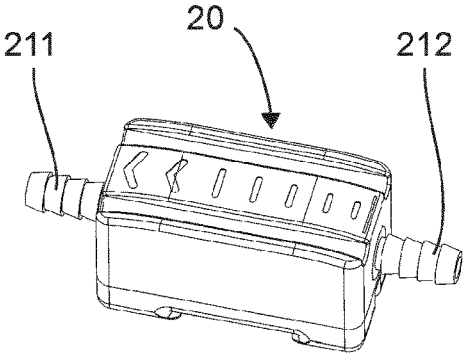
Figure 2B:
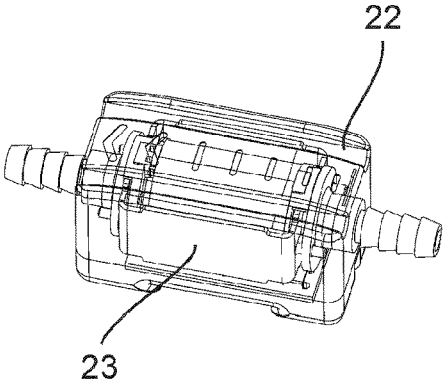
Figure 2C:
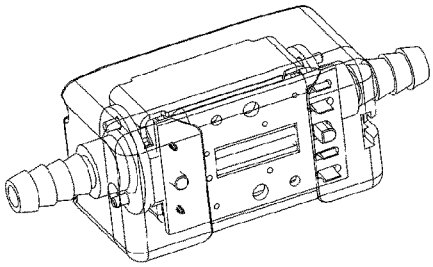
Figure 2D:
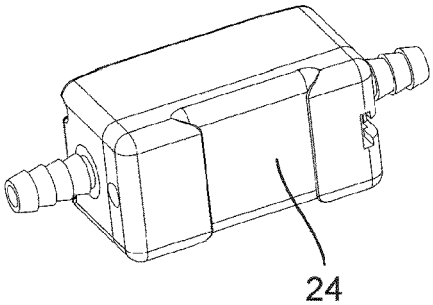
Figure 3A:
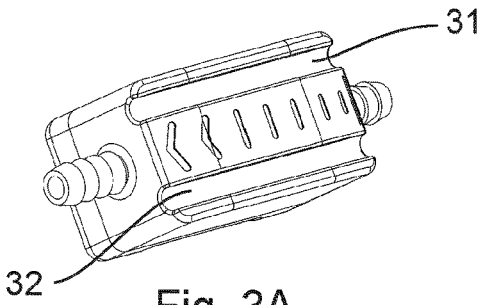
Figure 3B:
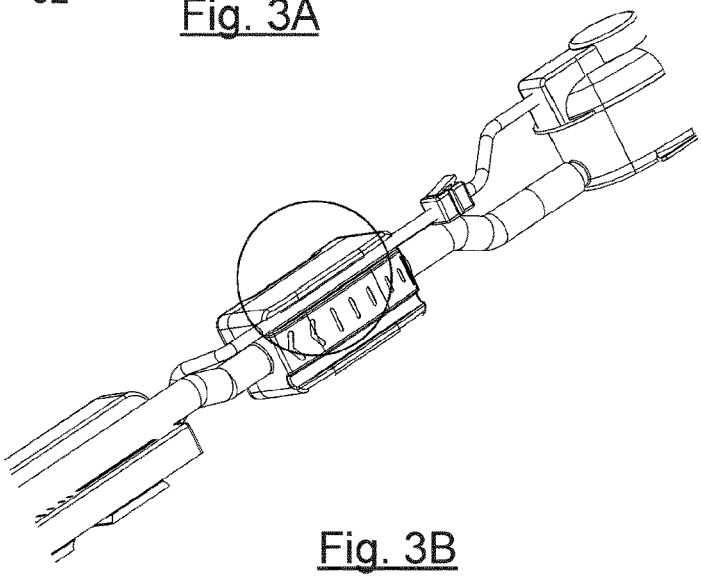
Figure 3C:
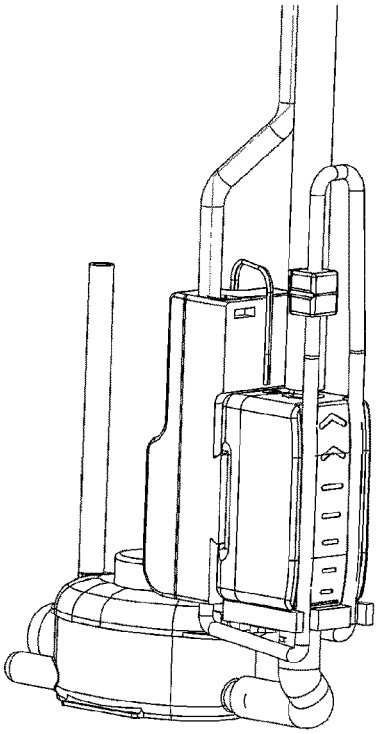
Figure 4:
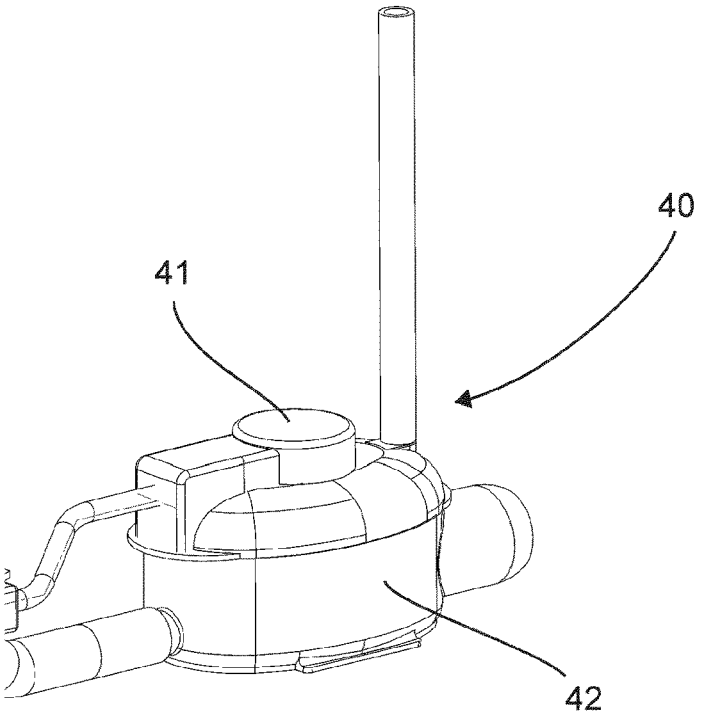
Figure 5B:
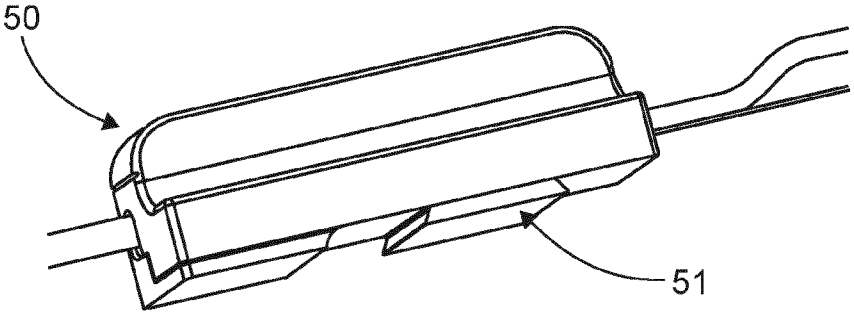
Figure 5C:
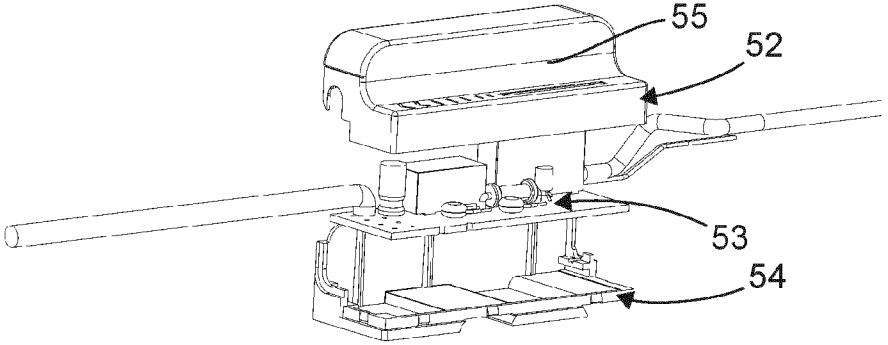
Figure 5A:
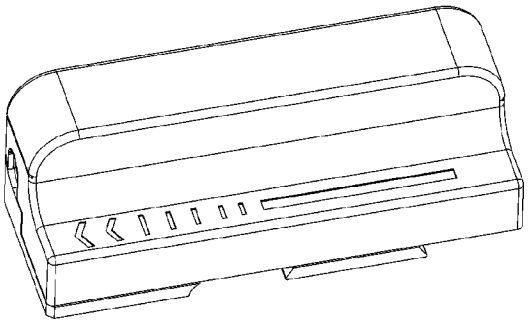
Figure 6A:
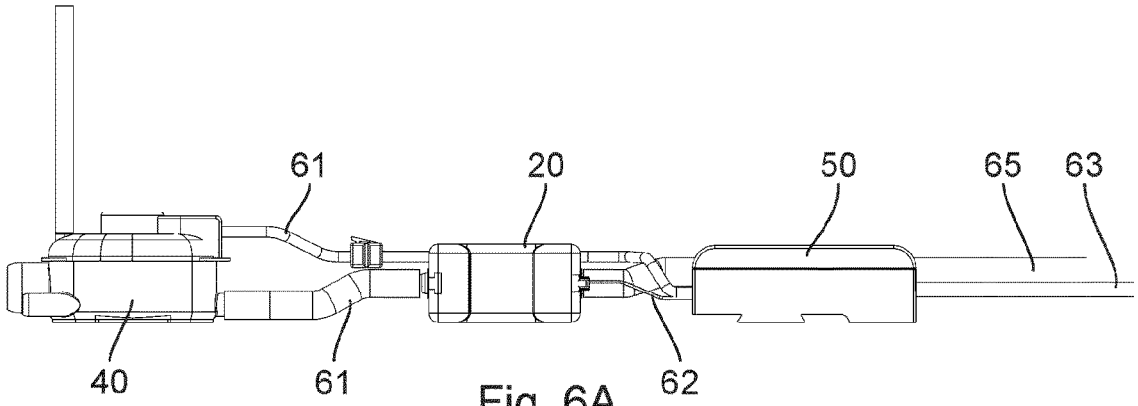
Figure 6B:
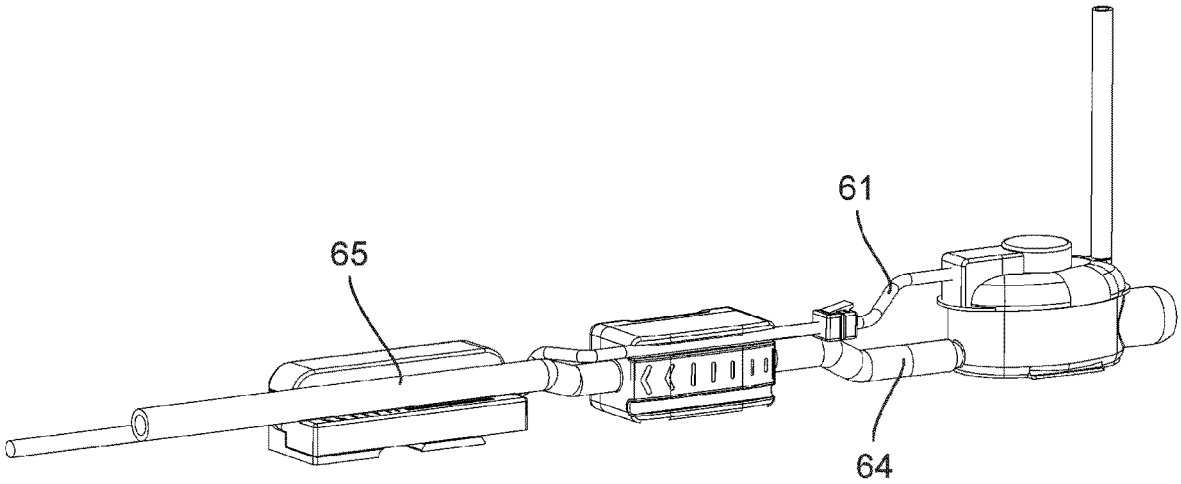
Figure 6C:
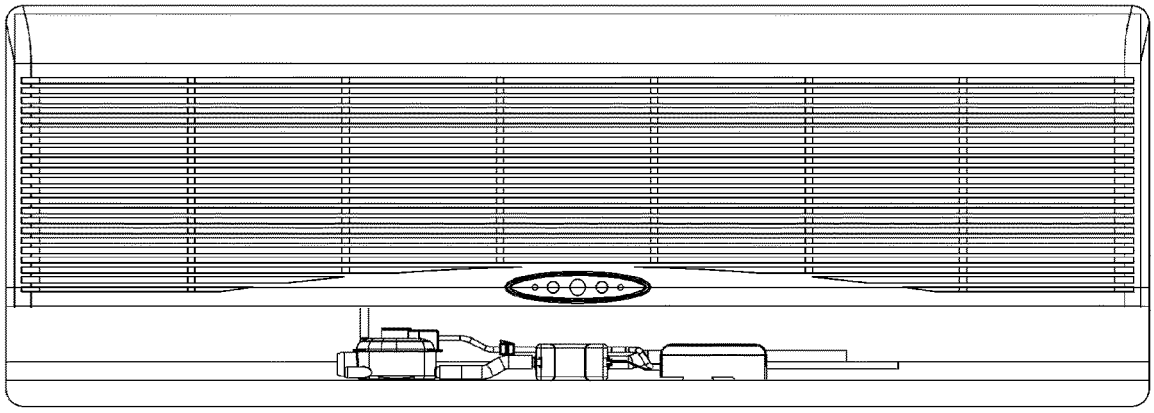
Figure 7C:
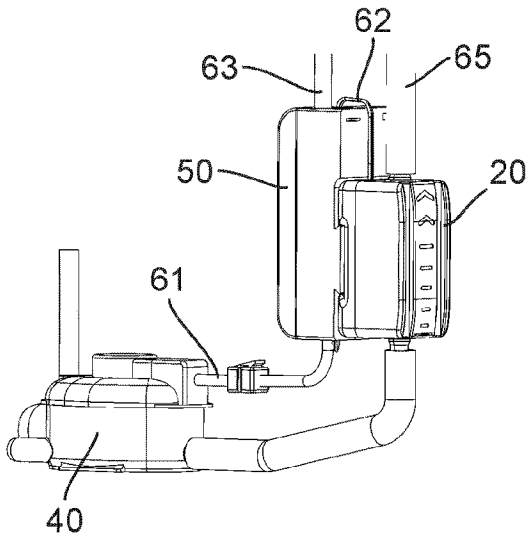
Figure 7B:
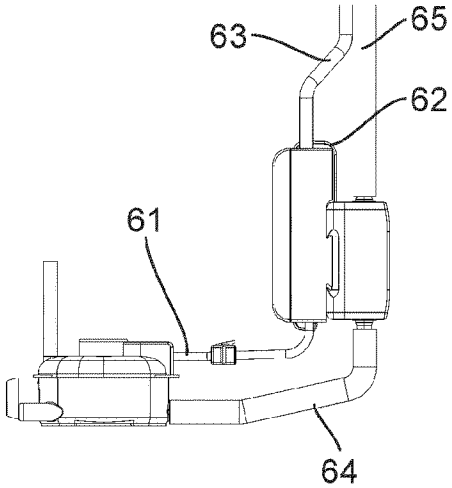
Figure 7A:
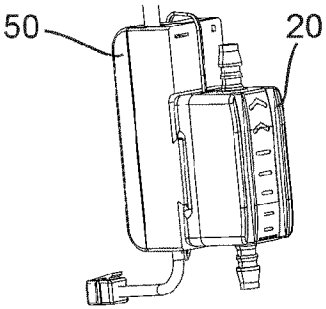

Other aims, features and advantages of the invention will become apparent upon reading the following description, given purely by way of illustrative and non-limiting example, and that refers to the appended figures, wherein:

FIG. 1 is a three-dimensional view of a one-piece condensate removal system of the prior art, described above, FIGS. 2A, 2B, 2C and 2D are four three-dimensional views of a pumping module according to a particular embodiment of the invention, the casing being fictitiously transparent in FIGS. 2B and 2C. FIG. 2D is a three-dimensional view of a pumping module the casing of which has a containing dovetail groove according to a particular embodiment of the invention, FIGS. 3A, 3B and 3C are three three-dimensional views of a pumping module, the casing of which has two grooves for receiving and guiding, an electrical cable, according to various embodiments of the invention, FIGS. 3B and 3C having installation configurations wherein the grooves are used to integrate an electrical cable, FIG. 4 is a three-dimensional view of a detection module, according to a particular embodiment of the invention, FIGS. 5A, 5B and 5C are three three-dimensional views of a control module, according to a particular embodiment of the invention, FIG. 5A showing a transparent view, FIG. 5B an opaque view, and FIG. 5C an exploded view of the control module, FIGS. 6A, 6B and 6C are three three-dimensional views of a condensate removal system according to a particular embodiment of the invention wherein the system is in an aligned configuration, FIG. 6C shows a mode of integrating the system into an air-conditioning unit, FIGS. 7A, 7B and 7C are three three-dimensional views of a condensate removal system according to a particular embodiment of the invention wherein the system is in a two-piece configuration, FIG. 7A showing a mode of assembling the control and pumping modules using a dovetail shape, FIGS. 8A, 8B, 8C, 8D and 8E show five three-dimensional views of a condensate removal system according to a particular embodiment of the invention wherein the system is in a one-piece configuration and using a shaped hose, FIGS. 9A, 9B and 9C show three three-dimensional views of a condensate removal system according to a particular embodiment of the invention wherein the system is in a one-piece configuration, and implementing an attachment part.

Figure 8E:
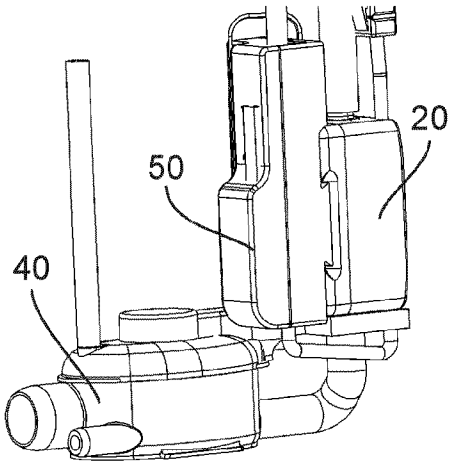
Figure 8D:
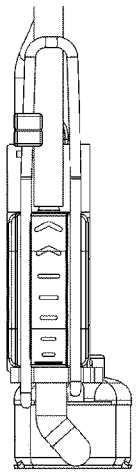
Figure 8C:
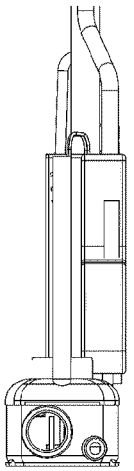
Figure 8B:
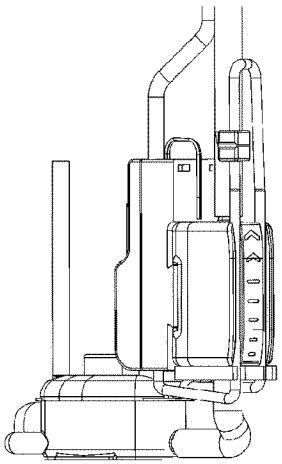
Figure 8A:
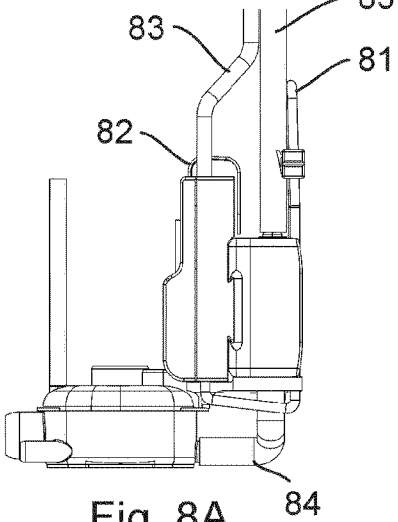
Figure 9C:
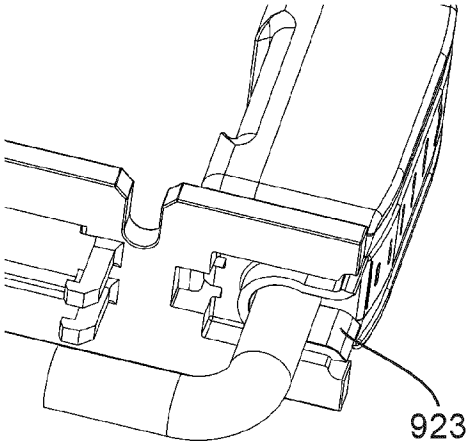
Figure 9B:
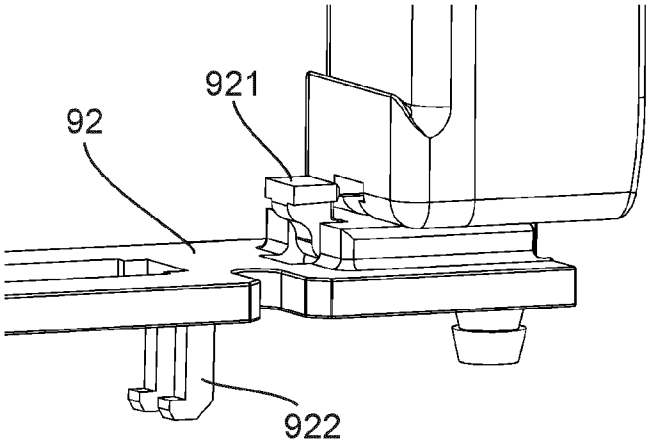
Figure 9A:
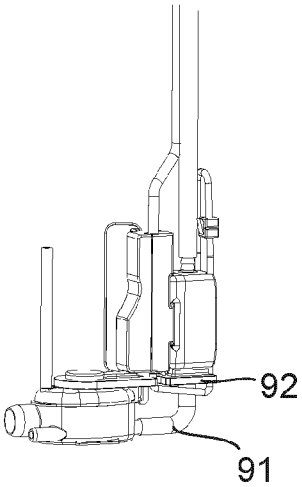
Figure 10B:
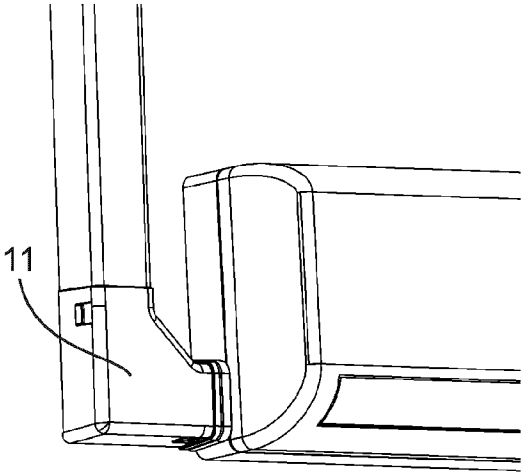
Figure 10A:
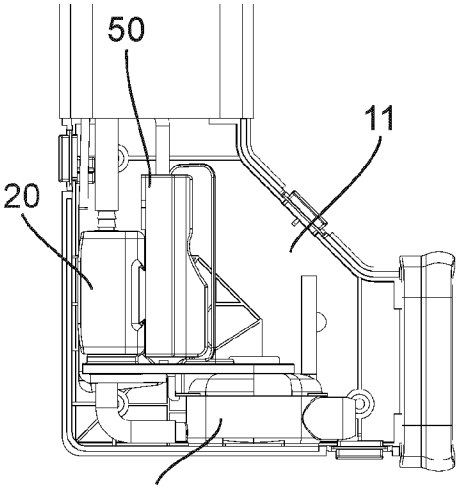
Figure 11:
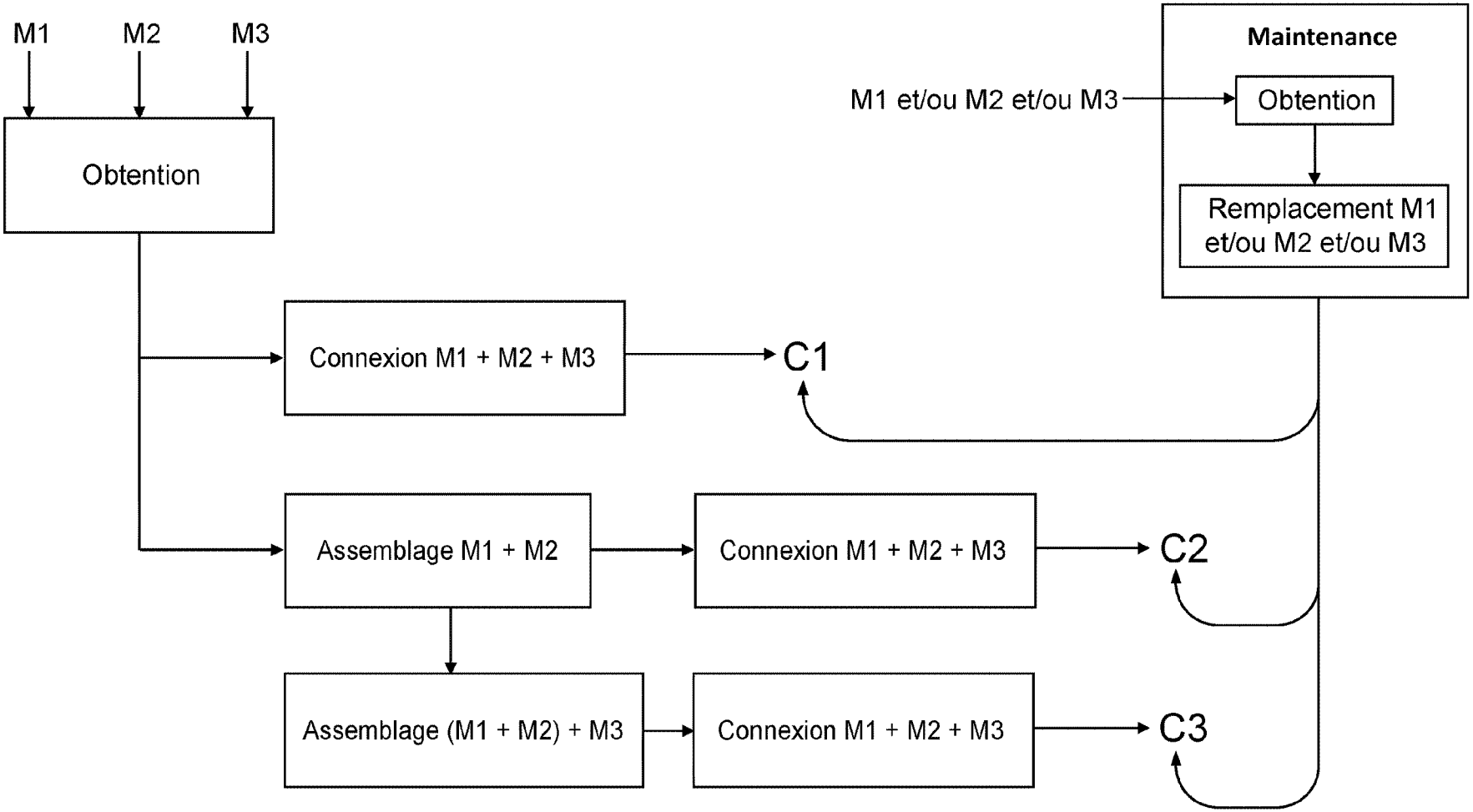
Figure 12A:
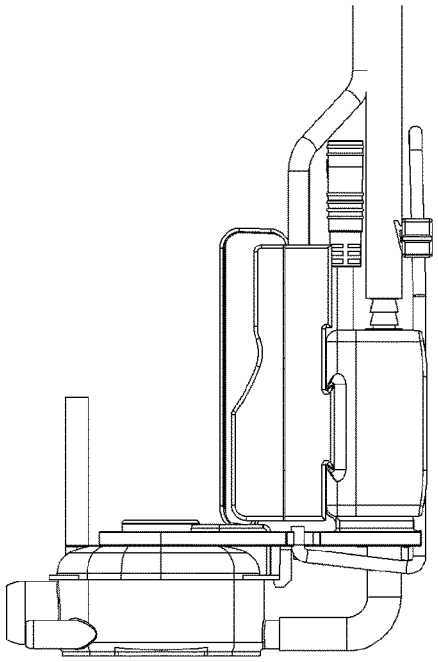
Figure 12B:
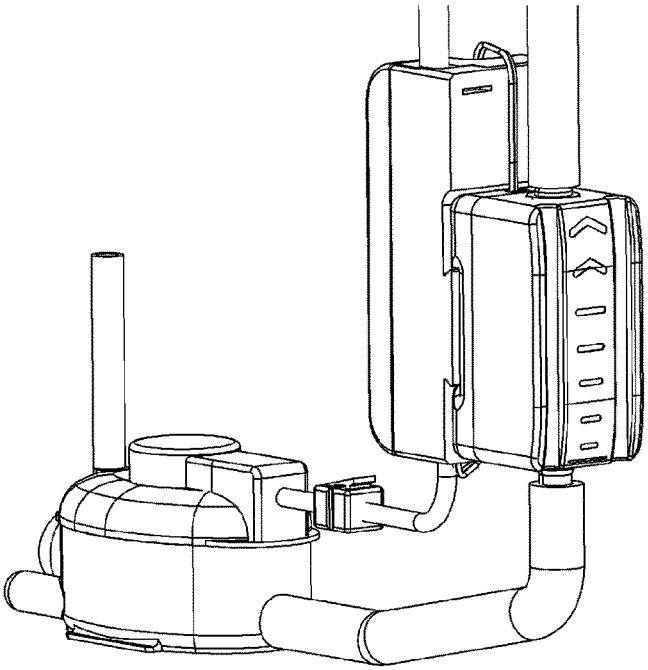
Figure 12C:
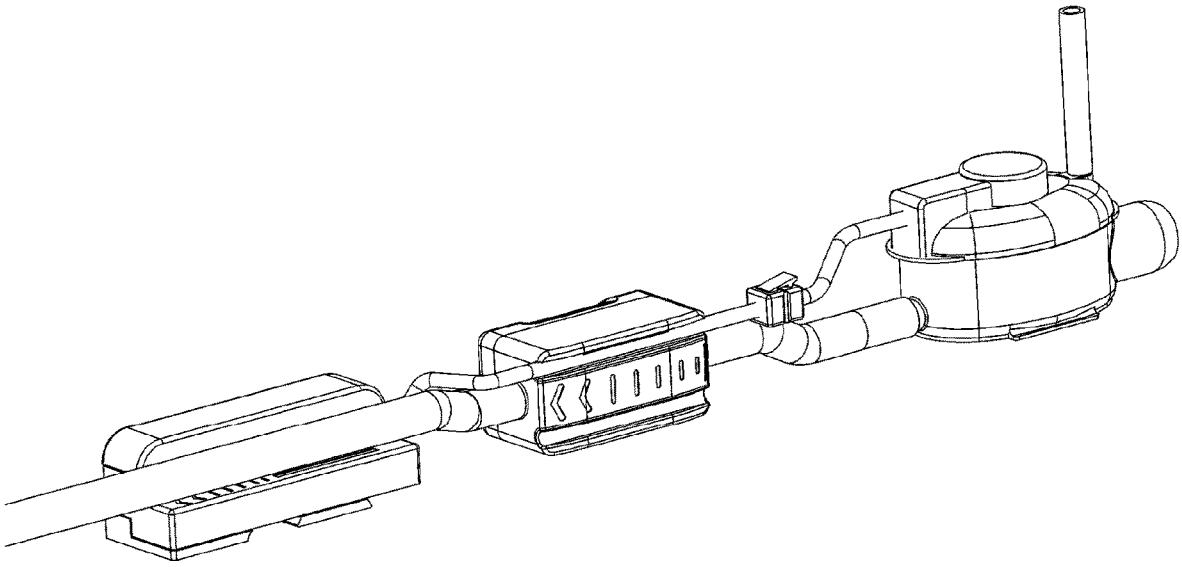

FIGS. 10A and 10B are an implementation of the system of FIG. 8A in an elbow installed on one side of a wall-mounted air-conditioning unit, according to a particular embodiment of the invention, FIG. 11 is an organisation chart showing the steps of installing and maintaining a condensate removal system according to a particular embodiment of the invention, FIGS. 12A, 12B and 12C are three three-dimensional views of three condensate removal systems according to three particular embodiments of the invention wherein the system is: in a one-piece configuration (FIG. 12A), in a two-piece configuration (FIG. 12B), and in an aligned configuration (FIG. 12C).

6. DETAILED DESCRIPTION OF AN EMBODIMENT OF THE INVENTION

6.1 General Principle

The general principal of the invention is based on a modular approach of condensate removal systems according to which it is possible to obtain at least the pumping, control and detection functions in at least three distinct separate modules, connected to one another via hydraulic and/or electrical connections. These three modules are designed to be assembled together, thus making it possible to create at least two installation configurations used in the trade.

The condensate removal system of the invention therefore consists of at least three modules:

- a pumping module (20) comprising particularly a pump (23) (FIGS. 2A to 2D);
- a detection module (40) consisting of a tank (42) and of a detector (41) capable of detecting at least two levels of condensates in the tank (FIG. 4);
- a control module (50) for controlling the pump on the basis of the levels of condensates (FIGS. 5A to 5C).

Each of these modules is configured, independently, to make it possible to implement these various configurations, as described hereinafter. Thus, each of these modules, considered independently, is novel and is one of the objects of the invention, in the same way as the corresponding installation and/or maintenance method.

In the embodiment described, three distinct installation configurations can be implemented according to the invention:

- an aligned configuration (FIGS. 6A to 6B), each module being installed separately and aligned substantially horizontally;
- a two-piece configuration (FIGS. 7A to 7C), two modules being attached;
- a one-piece configuration (FIGS. 8A to 8E), all of the modules being attached to one another.

The assembly of the modules can be carried out by various reversible attachment means: assembly by interlocking (elastic interlocking, sliding tenon, etc.), using magnet(s), screws, pin(s), using additional attachment part(s) (for example a plate with hooking/attaching means), etc.

All of the modules are optimised to obtain a minimum size and a maximum flexibility, making it possible to adapt to the shapes and constraints of each installation environment, this using only three modules. This optimisation may particularly result in the implementation of adapted overmouldings, by integrating/embedding tubes and/or cables to the casings of the modules using recess(es), (notch(es), groove(s), etc.).

6.2 Pumping Module (FIGS. 2A to 3C)

According to the implementation illustrated, the pumping module (20) consists of a pump (23), that may have an oscillating piston, of a thermal protection and of connection to other modules. In a particular implementation, the connection means can be:

- an electrical connection to the control module; and
- two hydraulic connections (211, 212): one to a detection module (40) (more specifically to a tank (42) of this module) and the other to the outside of the system.

In this particular embodiment, the pumping module is overmoulded with its PCB and a plug-in connector (shown in FIG. 2) or a wired connection solution for powering it. The overmoulding (22) thus makes it possible to reduce the size of the pumping module (20) to its minimum.

In addition, in this particular embodiment, the overmoulding is adapted to make it possible to assemble the pumping module with a second module. FIG. 2D shows one embodiment wherein the shape (24) is in containing dovetail. In other embodiments, this attachment means may be in the form of magnets, elastic interlocking, screws, etc.

Finally, in this particular embodiment, the overmoulding is also equipped with recess(es) for embedding a cable (connection means between the modules or also, a power cable, etc.) and/or a pipe. This makes it possible to reduce to the minimum the dimensions of the system after assembly. Examples of grooves and of assembly configurations are illustrated in FIGS. 3B and 3C, wherein the casing of the pumping module has two grooves (31, 32) for receiving the electrical cable (61, 81) connecting the detection module (40) to the control module (50).

6.3 Detection Module (FIG. 4)

The detection module (40) consists of a tank (42) and of a detector (41) capable of detecting at least two levels of condensates in the tank. In this particular embodiment, this module is connected via a hydraulic connection (64, 84, 91) to the pumping module (20) and via an electrical connection (61, 81) to the control module (50). This module makes it possible to detect the presence of water which makes it possible to activate the pump. The detection may be performed with any type of technology such as float detection, capacitive detection, resistive detection, optical detection, etc.

6.4 Control Module (FIGS. 5A to 5C)

The control module (50) communicates with the other two modules. In this particular embodiment, this communication is carried out via electrical cables (61, 62, 81, 82). This module makes it possible to control the pump on the basis of the levels of condensates detected by the detection module.

In a particular embodiment, the control module (50) consists of a plastic shell in two parts (52, 54) wherein an electronic board (53) equipped with a connector is installed for connecting/controlling the pump (62, 82) and the detector (61, 81). FIGS. 5A to 5C show one implementation of this module.

In a particular embodiment, this module may be intelligent and communicate with other modules or even with a central unit.

In a particular embodiment, the casing of this module is equipped with a shape for assembling with another module. FIG. 5B shows one embodiment wherein the shape (51) is in contained dovetail and makes it possible to assemble with the pumping module (20). In another embodiment, this attachment means may be in the form of magnets, elastic interlocking, screws, etc.

In this particular embodiment, the casing (52, 54) of the control module (50) has a housing (55) capable of receiving a tube (65), connecting the tank (42) of the detection module (40) to the pumping module (20).

6.5 Aligned Configuration (FIGS. 6A to 6C)

In the so-called aligned configuration, the control module (50), the pumping module (20) and the detection module (40) are separated and substantially aligned so that the assembly can, for example, be installed directly in the lower part of a wall-mounted air-conditioning unit, the useful height of which is restricted (FIG. 6C). Connection means connect each of the modules (61, 62, 64).

In this particular embodiment, the modules are disposed such as illustrated in FIGS. 6A and 6B, according to a substantially horizontal alignment. It is of course possible that this alignment be vertical or in another direction, or even that the modules be not aligned, but only at a distance from one another. The detection module (20) is connected by a first electrical cable (61) to the control module (50), this first electrical cable being embedded in a notch (31, 32) of the pumping module (20). The control module (50) is connected by a second electrical cable (62) to the pumping module (20). The entire system is powered by a third electrical cable (63) connected to the control module (50). The pumping module (20) is connected by a first pipe (64) to the tank (42) of the detection module (40) and finally, a second pipe (65) makes it possible to discharge the condensates extracted from the tank (42) to the outside of the system, this second pipe being housed in the control module (50, 55).

6.6 Two-Piece Configuration (FIGS. 7A to 7C)

In the two-piece configuration, two modules are assembled whereas the others remain separated, all of the modules are connected by connection means (61, 62, 64).

In this particular embodiment, illustrated in FIG. 7A, the pumping module (20) and the control module (50) are assembled together using a dovetail shaped interlocking (24, 51), whereas the detection module (40) is remote. This configuration can be used, for example, when the pumping module (20) is installed in a suspended ceiling whereas the detection module (40) is inserted into an air-conditioning unit.

In this embodiment, the various modules are connected by electrical cables (61, 62) and pipes (64) in a similar way to the preceding configuration.

6.7 One-Piece Configuration (FIGS. 8A to 10B)

The one-piece configuration makes it possible to assemble the pumping module (20), the control module (50) and the detection module (40) to form a one-piece product.

In this embodiment, this is permitted by a removable attachment part (92). The removable attachment part makes it possible to install the pumping module (20) and/or the control module (50) in vertical position. In one embodiment, the attachment part (92) has a guiding (922) and/or clamping function guaranteeing a holding of at least one connection means.

In this particular embodiment, the attachment between the block (20-50) formed by the pumping module and control module and the detection module (40) is permitted by the use of a shaped hose (84) (FIGS. 8A to 8E); this shaped hose here has a platform for supporting the pumping/control block (20-50) and for attaching the assembly to the third module (detection, 40).

In another embodiment, the attachment between the block (20-50), formed by the pumping module and the control module, and the detection module (40) is permitted by a plate (92) (FIGS. 9A to 9C). In this embodiment, a PVC tube (91) may replace the shaped hose. The plate (92) makes it possible to make the assembly rigid and robust using means for attaching (921, 922) to the detection module (40) and to the pumping module (20) or also to the control module (50). In a particular embodiment, the plate may directly integrate the hose. It may also integrate an electrical connection system to simplify the connector. In a particular embodiment, the plate has a function for clamping (of the clip (923) type) the pipe (91) guaranteeing optimal holding of the pipe without adding a clamping ring.

The modules are disposed such as illustrated in FIG. 8A. The detection module (40) is connected by a first electrical cable (81) to the control module (50), this first electrical cable being embedded in two notches (31, 32) of the pumping module (20). The control module (50) is connected by a second electrical cable (82) to the pumping module. The entire system is powered by a third electrical cable (83) connected to the control module (50). The pumping module (20) is connected by a first pipe (84) to the tank (42) of the detection module (40) and finally, a second pipe (85) makes it possible to discharge the condensates extracted from the tank (42) to the outside of the system.

Such a configuration can be used and inserted into an elbow (11) installed on the side of a wall-mounted air-conditioning unit (FIGS. 10A and 10B) or also on a wall or quite simply suspended.

6.8 Installation and Maintenance Method

The method for installing the system described above is illustrated in FIG. 12. Thus, the method requires, initially, obtaining three modules (M1, M2 and M3). Secondly, on the basis of the desired configuration, it is possible, either to directly install the modules after connection to obtain the aligned configuration C1, or to assemble the modules M1 and M2. Once assembled the modules M1 and M2 can either be connected to form the two-piece configuration C2, or assembled with the module M3 then connected to form the one-piece configuration C3. Of course, the modules can be separated, for the aligned installation.

In the event of failure of the system, it is necessary to carry out maintenance thereof. FIG. 12 also illustrates this aspect. Thus, during a maintenance operation of the system, the module or modules concerned by the technical problem is/are identified, then the latter simply need to be replaced, regardless of the configuration (C1, C2, C3) to obtain a system that is once again operational. This approach is simple, effective and inexpensive to implement whether economically or ecologically. Indeed, only the faulty module (and not the entire system) needs to be replaced during the maintenance and the possible attachment means are reversible, thus making it easier to change the modules.

In a particular embodiment, apart from an eco-design based on the use of recyclable plastics, the product may be part of an eco-responsible logic.

One or more exemplary embodiments of the present disclosure address at least some of the issues of the prior art.

Although the present disclosure has been described with reference to one or more examples, workers skilled in the art will recognize that changes may be made in form and detail without departing from the scope of the disclosure and/or the appended claims.

The invention claimed is:

1. A condensate removal system comprising at least three independent modules:

a pumping module, comprising a pump;

a detection module, comprising a tank for receiving condensates and a detector configured to detect at least two levels of condensates in said tank; and a control module, comprising electronics configured to control said pump based on said levels of condensates;

wherein each of said modules comprises a hydraulic and/or electrical connection to at least one other module of the at least three independent modules, and wherein at least two of said modules comprise a reversible attachment to one another, so that said at least three modules can be connected according to at least two configurations belonging to the group consisting of:

an aligned configuration, wherein said modules are installed separated from one another;

a two-piece configuration, wherein two of said modules are attached to one another; or a one-piece configuration, wherein said pumping module, said detection module and said control module are attached to one another.

2. The system according to claim 1, wherein at least one first of said modules has a casing configured to be assembled with a casing of a second of said modules, so as to attach said first and second modules.

3. The system according to claim 2, wherein said casings have shapes adapted for interlocking.

4. The system according to claim 2, wherein said first and second modules are said pumping module and said control module.

5. The system according to claim 1, wherein the system comprises a removable attachment part for attaching to one another said detection module and said pumping module and/or said control module.

6. The system according to claim 5, wherein said attachment part comprises a plate having an attachment for attaching to said detection module and an attachment for attaching to said pumping module or to said control module.

7. The system according to claim 5, wherein said attachment part makes it possible to install at least one of said pumping module or said control module in vertical position.

8. The system according to claim 5, wherein said attachment part comprises at least one part among:

a hose;

at least one portion for guiding and/or clamping at least one of said hydraulic and/or electrical connection.

9. The system according to claim 8, wherein said guiding and/or clamping portion comprises a housing for receiving a clip for holding a tube.

10. The system according to claim 1, wherein at least one of said modules has a casing wherein is formed a housing for receiving, at least partly, and/or for guiding, an electrical cable and/or a tube.

11. The system according to claim 10, wherein said pumping module comprises at least one groove capable of receiving an electrical cable.

12. The system according to claim 10, wherein said control module comprises at least one housing capable of receiving a tube connecting said detection module to said pumping module.

13. The system according to claim 1, wherein said the pump of the pumping module comprises an oscillating piston pump.

14. The system according to claim 1, wherein said detection module comprises at least one sensor belonging to the group consisting of:

the float sensors;

the capacitive sensors;

the resistive sensors;

the optical sensors.

15. The system according to claim 3, wherein said casings have shapes adapted for interlocking by having respectively a contained dovetail tenon and a containing dovetail groove.

16. A method comprising:

installing and/or maintaining a condensate removal system comprising at least three independent modules:

a pumping module, comprising a pump;

a detection module, comprising a tank for receiving condensates and a detector configured to detect at least two levels of condensates in said tank; and a control module, comprising electronics configured to control said pump based on said levels of condensates;

wherein each of said modules comprises a hydraulic and/or electrical connection to at least one other module of the at least three independent modules, wherein at least two of said modules comprise means for reversible attachment to one another, and wherein the installing and/or maintaining comprises:

obtaining said at least three modules, separated from one another;

assembling said at least three modules according to at least one configuration belonging to the group consisting of:

an aligned configuration, wherein said modules are installed separated from one another and aligned substantially horizontally;

a two-piece configuration, wherein two of said modules are attached to one another; or a one-piece configuration, wherein said pumping module, said detection module and said control module are attached to one another, based on an available space and/or of the configuration of an installation receiving said condensate removal system.

17. The method according to claim 16, wherein the method comprises replacing and/or intervening on only one of said modules.

18. The method according to claim 16, wherein in said one-piece configuration, said modules are assembled so as to be able to be housed particularly in an elbow installed on one side of a wall-mounted air-conditioning unit.

* * * * *